US012473170B2

(12) United States Patent
Okada

(10) Patent No.: US 12,473,170 B2
(45) Date of Patent: Nov. 18, 2025

(54) SHEET POSTPROCESSING APPARATUS INCLUDING RESTRICTION DEVICE THAT RESTRICTS MOVEMENT OF LOWER GUIDE OF INLET GUIDE, AND IMAGE FORMING SYSTEM

(71) Applicant: KYOCERA Document Solutions Inc., Osaka (JP)

(72) Inventor: Rina Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 164 days.

(21) Appl. No.: 18/596,459

(22) Filed: Mar. 5, 2024

(65) Prior Publication Data

US 2024/0308811 A1 Sep. 19, 2024

(30) Foreign Application Priority Data

Mar. 13, 2023 (JP) ..... 2023-038487

(51) Int. Cl.
*B65H 35/00* (2006.01)

(52) U.S. Cl.
CPC ..... *B65H 35/0086* (2013.01); *B65H 2301/51532* (2013.01); *B65H 2801/27* (2013.01)

(58) Field of Classification Search
CPC .. B65H 35/00; B65H 35/006; B65H 35/0066; B65H 35/0073; B65H 35/008; B65H 35/0086
See application file for complete search history.

(56) References Cited

U.S. PATENT DOCUMENTS 5,746,162 A * 5/1998 Hosoi ..... B65H 39/10 700/59
5,772,197 A * 6/1998 Aoki ..... G03G 15/6538 270/58.08
6,120,020 A * 9/2000 Asao ..... B42C 1/12 271/189
7,172,185 B2 * 2/2007 Hattori ..... B26F 1/0092 83/74
7,762,539 B2 * 7/2010 Nagata ..... B65H 29/14 399/92

(Continued)

FOREIGN PATENT DOCUMENTS

JP 2006116662 A 5/2006

*Primary Examiner* — Adam J Eiseman
*Assistant Examiner* — Richard D Crosby, Jr.
(74) *Attorney, Agent, or Firm* — IP Business Solutions, LLC

(57) ABSTRACT

A sheet postprocessing apparatus includes an inlet guide, a perforation device, and a collection tank. The inlet guide includes an upper guide and a lower guide. The perforation device is located downstream of the inlet guide in a sheet transport direction. The collection tank is located on a lower side of the perforation device. The lower guide is supported so as to pivot in an up-down direction, about an end portion in a sheet width direction. The collection tank is removably supported, by sliding in the sheet width direction. The lower guide includes a lever located on the other end portion in the sheet width direction, and configured to disengage the lower guide from the upper guide. The collection tank includes a restriction device opposed to the lever and configured to restrict pivotal movement of the lower guide, when the collection tank is attached to the perforation device.

6 Claims, 8 Drawing Sheets

(56) References Cited

U.S. PATENT DOCUMENTS

| | | | | |
|---|---|---|---|---|
| 7,987,751 | B2 * | 8/2011 | Shiokawa | G03G 15/6523 83/167 |
| 8,434,759 | B2 * | 5/2013 | Abe | G03G 15/6567 271/244 |
| 8,730,540 | B2 * | 5/2014 | Akiyama | H04N 1/00787 399/370 |
| 11,235,942 | B2 * | 2/2022 | Nakano | B65H 31/38 |
| 11,305,573 | B2 * | 4/2022 | Mutsuno | B26F 1/0092 |
| 12,030,737 | B2 * | 7/2024 | Takahara | B65H 1/022 |
| 2005/0115377 | A1 * | 6/2005 | Kobayashi | G03G 15/6582 83/684 |
| 2005/0211035 | A1 * | 9/2005 | Tamura | B26D 5/00 83/167 |
| 2012/0018946 | A1 * | 1/2012 | Iguchi | B65H 37/04 271/225 |
| 2013/0134661 | A1 * | 5/2013 | Yoshinaga | B65H 85/00 271/225 |
| 2016/0347569 | A1 * | 12/2016 | Taki | B65H 29/145 |
| 2019/0367312 | A1 * | 12/2019 | Kishimoto | B65H 31/02 |
| 2019/0389237 | A1 * | 12/2019 | Nishimura | G03G 15/6523 |
| 2021/0099591 | A1 * | 4/2021 | Arakawa | B65H 1/266 |
| 2021/0299900 | A1 * | 9/2021 | Muto | B26F 1/44 |
| 2022/0204290 | A1 * | 6/2022 | Tatematsu | B65H 3/0684 |

* cited by examiner

SHEET POSTPROCESSING APPARATUS INCLUDING RESTRICTION DEVICE THAT RESTRICTS MOVEMENT OF LOWER GUIDE OF INLET GUIDE, AND IMAGE FORMING SYSTEM

INCORPORATION BY REFERENCE

This application claims priority to Japanese Patent Application No. 2023-038487 filed on Mar. 13, 2023, the entire contents of which are incorporated by reference herein.

BACKGROUND

The present disclosure relates to a sheet postprocessing apparatus that performs predetermined postprocessing on a sheet having an image formed thereon by an image forming apparatus, and an image forming system including such sheet postprocessing apparatus.

Many of existing sheet postprocessing apparatuses include an inlet guide for transporting the sheet to a transport route, a perforation device, and a collection tank. The perforation device perforates the sheet delivered from the inlet guide. The collection tank receives perforation waste, created through the perforating operation.

SUMMARY

The disclosure proposes further improvement of the foregoing techniques.

In an aspect, the disclosure provides sheet postprocessing apparatus including an inlet guide, a perforation device, and a collection tank. The inlet guide includes an upper guide constituting an upper wall of a transport route through which a sheet is transported, and a lower guide constituting a lower wall of the transport route. The perforation device is located downstream of the inlet guide in a sheet transport direction, and perforates the sheet delivered from the inlet guide. The collection tank is located on a lower side of the perforation device, and receives perforation waste, created through a perforating operation. The lower guide is supported so as to pivot in an up-down direction with respect to the upper guide, about an end portion in a sheet width direction, orthogonal to the sheet transport direction. The collection tank is removably supported, by sliding in the sheet width direction with respect to the perforation device. The lower guide includes a lever located on the other end portion in the sheet width direction, and configured to cancel engagement between the lower guide from the upper guide. The collection tank includes a restriction device opposed to the lever and configured to restrict a pivotal movement of the lower guide, when the collection tank is attached to the perforation device.

In another aspect, the disclosure provides an image forming system including the foregoing sheet postprocessing apparatus and an image forming apparatus. The image forming apparatus forms an image on the sheet, and delivers the sheet to the transport route.

DETAILED DESCRIPTION

First Embodiment

Hereafter, a first embodiment of the disclosure will be described in detail, with reference to the drawings. In the following description regarding a sheet postprocessing apparatus 1 according to the embodiments of the disclosure, the direction in which a rotation axis C of a shaft 233 shown in FIG. 4 extends will simply be referred to as "axial direction (A-A' direction)". The directions hereinafter referred to are merely for the purpose of description, and not intended to limit a positional relation or a specific direction of the elements.

Figure 1:
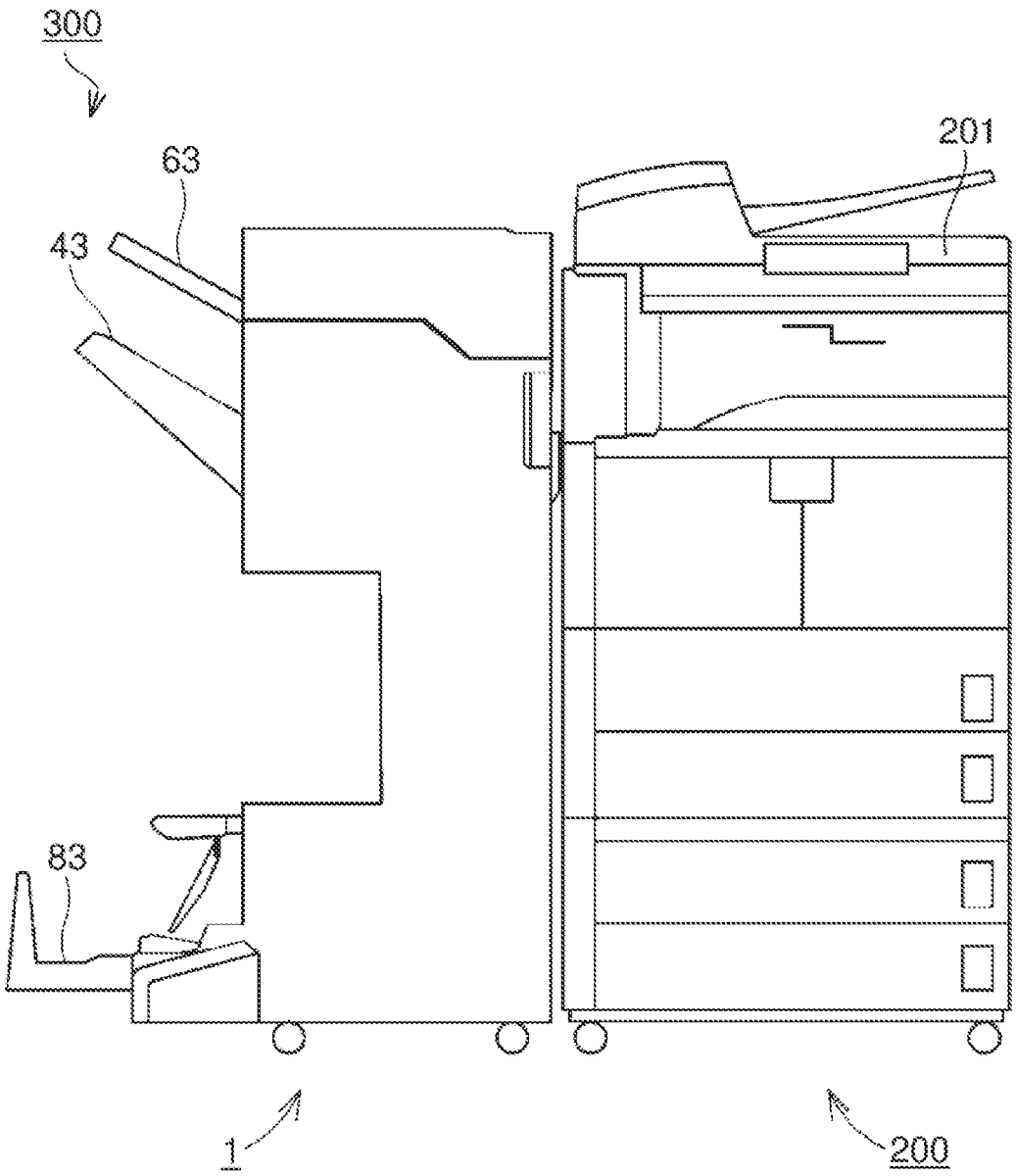
FIG. 1 is a schematic front view of an image forming system 300, including a sheet postprocessing apparatus 1 according to a first embodiment of the disclosure.

FIG. 1 is a schematic front view showing a configuration of an image forming system 300, including a sheet postprocessing apparatus 1 according to a first embodiment of the disclosure, and an image forming apparatus 200 to which the sheet postprocessing apparatus 1 is connected.

Referring to FIG. 1, the image forming apparatus 200 prints an image on the sheet, on the basis of image data inputted from outside via a network communication device, or image data read by an image reading device 201 provided on the upper side of the image forming apparatus 200.

The sheet postprocessing apparatus 1 is removably connected to a side face of the image forming apparatus 200. The sheet postprocessing apparatus 1 performs postprocessing, such as forming a punch hole or binding, with respect to the sheet having the image formed (printed) thereon by the image forming apparatus 200. Here, the sheet postprocessing apparatus 1 may be configured to transport the sheet set on a tray by the user to a predetermined position for the postprocessing, and perform the postprocessing on the sheet thus transported, instead of performing the postprocessing on the sheet automatically transported from the image forming apparatus 200.

Figure 2:
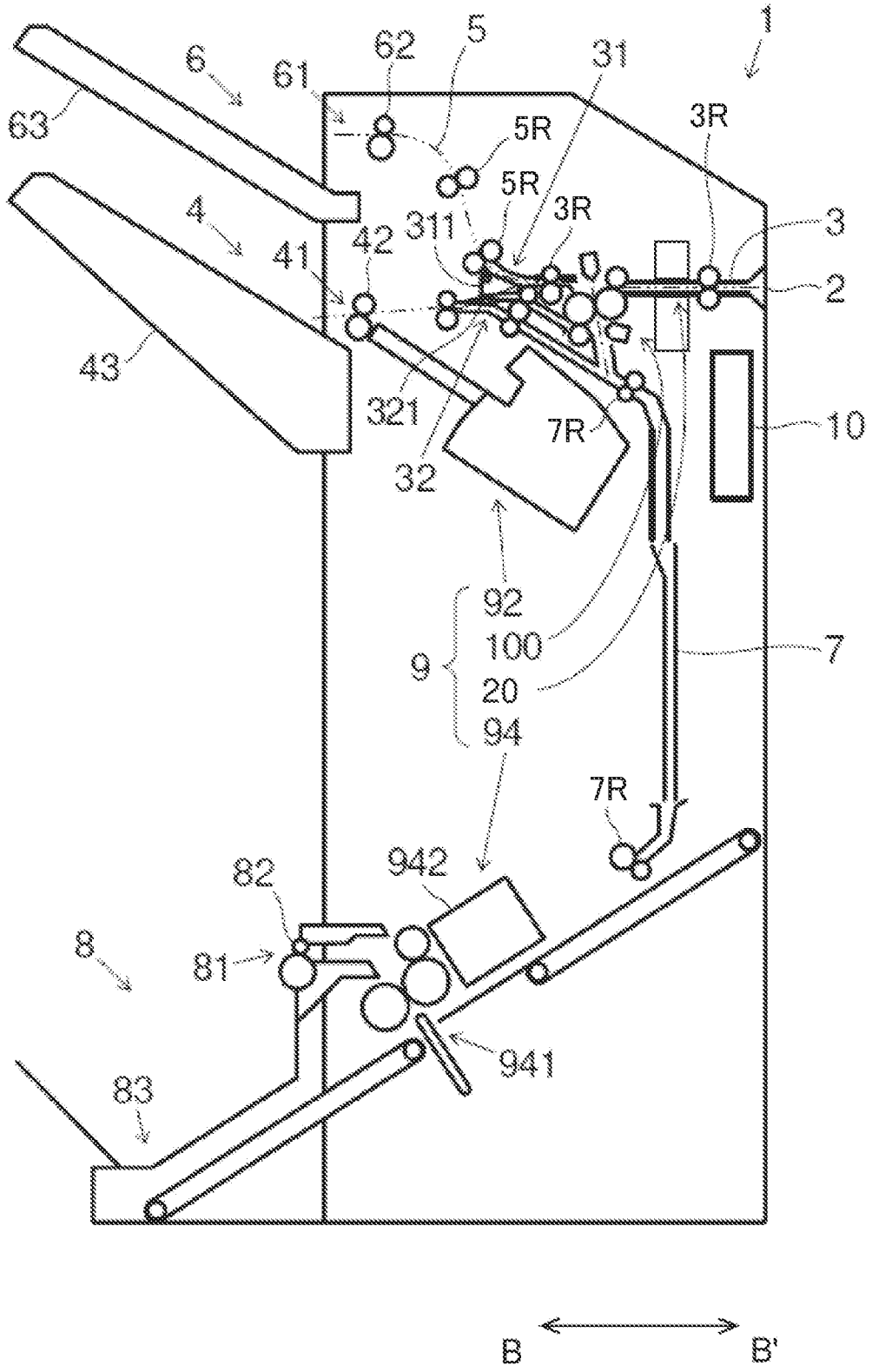
FIG. 2 is a side cross-sectional view showing a configuration of the sheet postprocessing apparatus 1.

FIG. 2 is a side cross-sectional view schematically showing a configuration of the sheet postprocessing apparatus 1. As shown in FIG. 2, the sheet postprocessing apparatus 1 includes a sheet inlet 2, a first sheet transport route 3, a first sheet delivery device 4, a second sheet transport route 5, a second sheet delivery device 6, a third sheet transport route 7, a third sheet delivery device 8, a postprocessing device 9, and a postprocessing controller 10.

The sheet inlet 2 is an opening formed in the side face of the sheet postprocessing apparatus 1 opposed to the image forming apparatus 200. The sheet transported from the image forming apparatus 200 to the sheet postprocessing apparatus 1 passes the sheet inlet 2, and is introduced into inside of the sheet postprocessing apparatus 1.

The first sheet transport route 3, exemplifying the transport route in the disclosure, extends generally horizontally in the direction away from the image forming apparatus 200 (to the left in FIG. 2), from the sheet inlet 2 to the first sheet delivery device 4. Hereinafter, the direction from the sheet inlet 2 toward the first sheet delivery device 4 will be referred to as first sheet transport direction along the first sheet transport route 3. The sheet inlet 2 is located at the upstream end of the first sheet transport route 3, in the first sheet transport direction. The first sheet transport route 3 includes a plurality of transport roller pairs 3R, by which the sheet introduced into the sheet postprocessing apparatus 1, through the sheet inlet 2, is transported to the downstream side in the first sheet transport direction.

The first sheet delivery device 4 is provided on the side face of the sheet postprocessing apparatus 1, opposite to the side face opposed to the image forming apparatus 200. The first sheet delivery device 4 is located on the downstream end of the first sheet transport route 3, in the first sheet transport direction. The first sheet delivery device 4 includes a first delivery port 41, a first delivery roller pair 42, and a first output tray 43.

The first delivery port 41 is located at the downstream end of the first sheet transport route 3 in the first sheet transport direction. The first delivery roller pair 42 is located at the position corresponding to the first delivery port 41. The first output tray 43 is located downstream of the first delivery port 41, in the first sheet transport direction. The sheet transported through the first sheet transport route 3 as far as the first delivery port 41 is made to pass the first delivery port 41 by the first delivery roller pair 42, and delivered to the first output tray 43. The first output tray 43 is one of final destinations of the sheet that has undergone the postprocessing performed by the sheet postprocessing apparatus 1.

The second sheet transport route 5 is branched from the first sheet transport route 3 at a first branch point 31, and extends obliquely upward in the direction away from the image forming apparatus 200 (to the left in FIG. 2), as far as the second sheet delivery device 6. The first branch point 31 is located downstream of the perforation device 20, in the first sheet transport direction along the first sheet transport route 3. Hereinafter, the direction from the first branch point 31 toward the second sheet delivery device 6 will be referred to as second sheet transport direction along the second sheet transport route 5. The first branch point 31 is located at the upstream end of the second sheet transport route 5, in the second sheet transport direction. The second sheet transport route 5 includes a plurality of transport roller pairs 5R, by which the sheet, transported along the first sheet transport route 3 and branched at the first branch point 31, is transported toward the second sheet delivery device 6.

The first branch point 31 includes a first switching guide 311. The first switching guide 311 is configured to swing between a position for guiding the sheet transported along the first sheet transport route 3 from the sheet inlet 2, toward the first delivery port 41 along the first sheet transport route 3, and a position for causing the sheet to branch off from the first sheet transport route 3 and guiding the sheet to the second sheet transport route 5. Further, the first switching guide 311 swings to a position for guiding the sheet that has undergone a folding operation and passes a second folding transport route, to the second sheet transport route 5. The first switching guide 311 is connected to a drive mechanism, so that the postprocessing controller 10 controls the action of the first switching guide 311.

The second sheet delivery device 6 is provided on the side face of the sheet postprocessing apparatus 1, opposite to the side face opposed to the image forming apparatus 200, and on the upper side of the first sheet delivery device 4. The second sheet delivery device 6 is located at the downstream end of the second sheet transport route 5, in the second sheet transport direction. The second sheet delivery device 6 includes a second delivery port 61, a second delivery roller pair 62, and a second output tray 63.

The second delivery port 61 is located at the downstream end of the second sheet transport route 5 in the second sheet transport direction. The second delivery roller pair 62 is located at the position corresponding to the second delivery port 61. The second output tray 63 is located downstream of the second delivery port 61, in the second sheet transport direction. The sheet transported through the second sheet transport route 5 as far as the second delivery port 61 is made to pass the second delivery port 61 by the second delivery roller pair 62, and delivered to the second output tray 63. The second output tray 63 is one of the final destinations of the sheet that has undergone the postprocessing performed by the sheet postprocessing apparatus 1. To the second output tray 63, the sheet not subjected to the postprocessing, or a small-sized sheet is also delivered.

The third sheet transport route 7 is branched from the first sheet transport route 3 at a second branch point 32, and extends downward to the third sheet delivery device 8. Hereinafter, the direction from the second branch point 32 toward the third sheet delivery device 8 will be referred to as third sheet transport direction along the third sheet transport route 7. The second branch point 32 is located downstream of the first branch point 31, in the first sheet transport direction along the first sheet transport route 3, and at the upstream end of the third sheet transport route 7 in the third sheet transport direction. The third sheet transport route 7 includes a plurality of transport roller pairs 7R, by which the sheet, transported along the first sheet transport route 3 and branched at the second branch point 32, is transported toward the third sheet delivery device 8.

The second branch point 32 includes a second switching guide 321. The second switching guide 321 is configured to swing between a position for guiding the sheet transported along the first sheet transport route 3 from the sheet inlet 2, toward the first delivery port 41 along the first sheet transport route 3, and a position for guiding the sheet transported along the first sheet transport route 3 from the sheet inlet 2, and made to pass the second branch point 32 and then switched back, to the third sheet transport route 7. The second switching guide 321 is connected to the drive mechanism, so that the postprocessing controller 10 controls the action of the second switching guide 321.

The third sheet delivery device 8 is provided on the side face of the sheet postprocessing apparatus 1, opposite to the side face opposed to the image forming apparatus 200, and on the lower side of the first sheet delivery device 4, at the position close to the lower end portion of the sheet postprocessing apparatus 1. The third sheet delivery device 8 includes a third delivery port 81, a third delivery roller pair 8, and a third output tray 83.

The third delivery port 81 is located at the downstream end of the third sheet transport route 7 in the third sheet transport direction. The third delivery roller pair 82 is located at the position corresponding to the third delivery port 81. The third output tray 83 is located downstream of the third delivery port 81, in the third sheet transport direction. The sheet transported through the third sheet transport route 7 as far as the third delivery port 81 is made to pass the third delivery port 81 by the third delivery roller pair 82, and delivered to the third output tray 83. The third output tray 83 is one of the final destinations of the sheet that has undergone the postprocessing performed by the sheet postprocessing apparatus 1.

The postprocessing device 9 performs predetermined postprocessing, to the sheet on which an image has been formed by the image forming apparatus 200, and introduced into the sheet postprocessing apparatus 1. The postprocessing device 9 includes the perforation device 20, a sheet binding unit 92, a sheet folding device 100, and a bookbinding device 94.

The perforation device 20 is located on a part of the first sheet transport route 3, at a position immediately close to the sheet inlet 2, on the downstream side in the first sheet transport direction. The perforation device 20 perforates the sheet being transported along the first sheet transport route 3, thereby forming a punch hole in the sheet. Further details of the configuration of the perforation device 20 will be subsequently described.

The sheet binding device 92 is located immediately close to the first sheet delivery device 4, on the upstream side in the first sheet transport direction along the first sheet transport route 3. The sheet binding device 92 performs a stapling operation (binding operation) on a sheaf of sheets, formed by stacking a plurality of sheets on each other, thereby binding the sheaf of sheets. Further details of the configuration of the sheet binding device 92 will be subsequently described.

The sheet folding device 100 located downstream of the perforation device 20, and upstream of the sheet binding device 92, in the first sheet transport direction along first sheet transport route 3. The sheet folding device 100 folds a single sheet, to form a crease thereon. The sheet folding device 100 is configured fold the single sheet, for example, into half-fold, z-fold, 6-page accordion, or letter-fold.

The bookbinding device 94 is located immediately close to the third sheet delivery device 8, on the upstream side in the third sheet transport direction along the third sheet transport route 7. The bookbinding device 94 includes a saddle folding device 941 and a saddle binding device 942. The bookbinding device 94 performs a saddle folding operation and a saddle binding operation, with respect to a sheaf of sheets formed by stacking a plurality of sheets on each other, thereby forming a booklet.

The postprocessing controller 10 includes a CPU, a storage device, and other electronic circuits and electronic parts. The postprocessing controller 10 is communicably connected to a main controller of the image forming apparatus 200 (see FIG. 1). The postprocessing controller 10 receives commands from the main controller, and controls, using the CPU, the constituent elements of the sheet postprocessing apparatus 1 according to control programs and data stored in the storage device, thereby executing the operation to realize the functions of the sheet postprocessing apparatus 1. The first sheet transport route 3, the first sheet delivery device 4, the second sheet transport route 5, the second sheet delivery device 6, the third sheet transport route 7, the third sheet delivery device 8, and the postprocessing device 9 each individually receive the commands from the postprocessing controller 10, to perform the postprocessing on the sheet, in collaboration with each other. Here, the functions of the postprocessing controller 10 may be performed by the main controller of the image forming apparatus 200.

Figure 3:
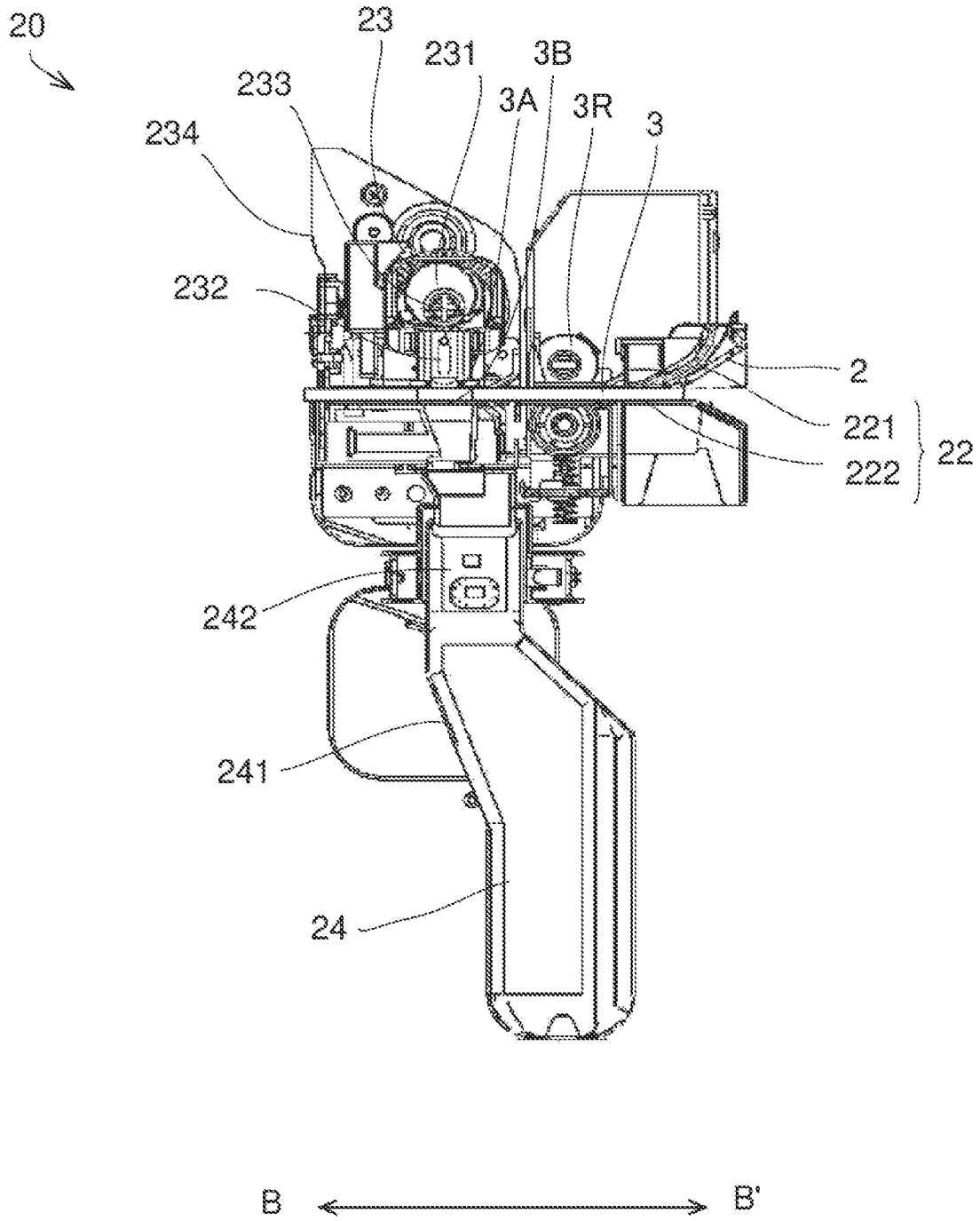
FIG. 3 is a side cross-sectional view showing a perforation device 20 provided in the sheet postprocessing apparatus 1.
Figure 4:
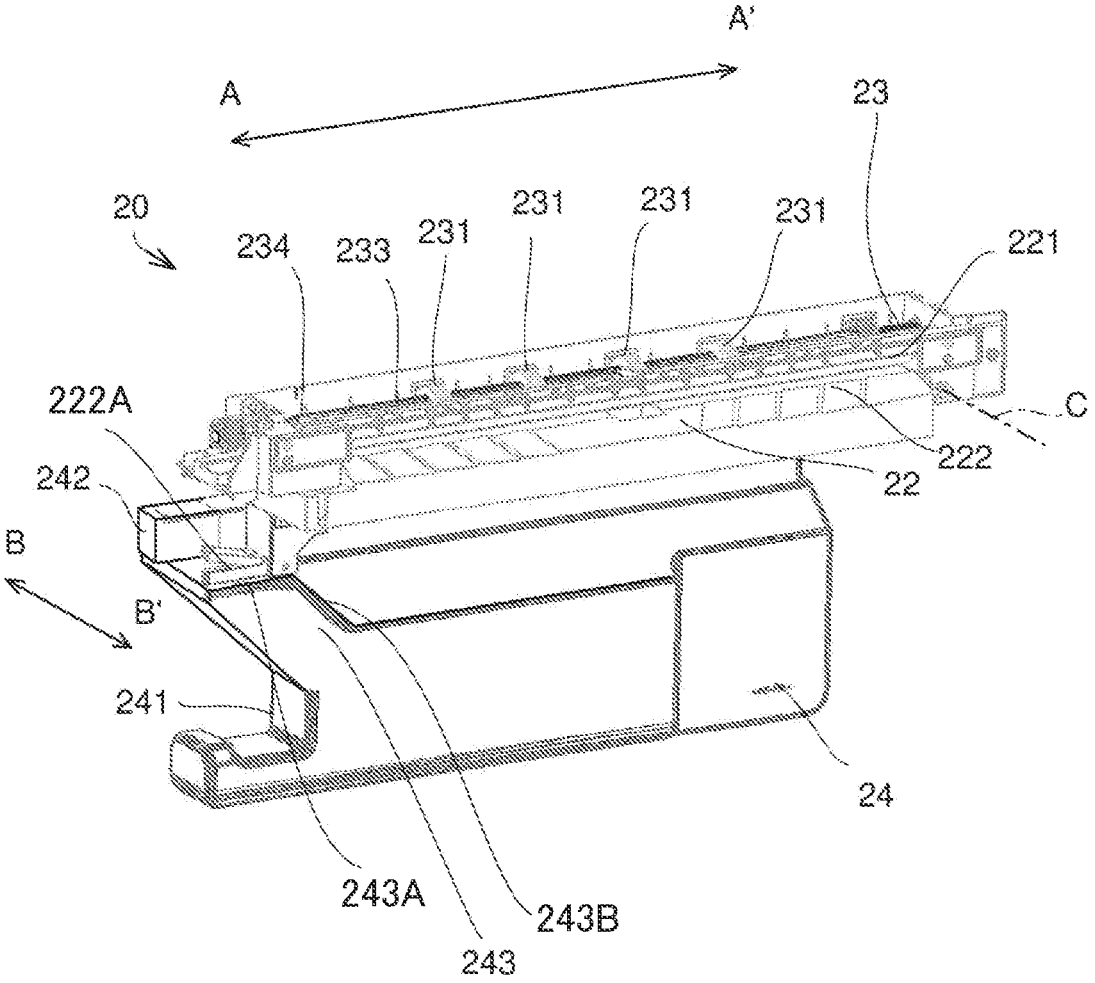
FIG. 4 and FIG. 5 are perspective views each showing the perforation device 20 provided in the sheet postprocessing apparatus 1.
Figure 5:
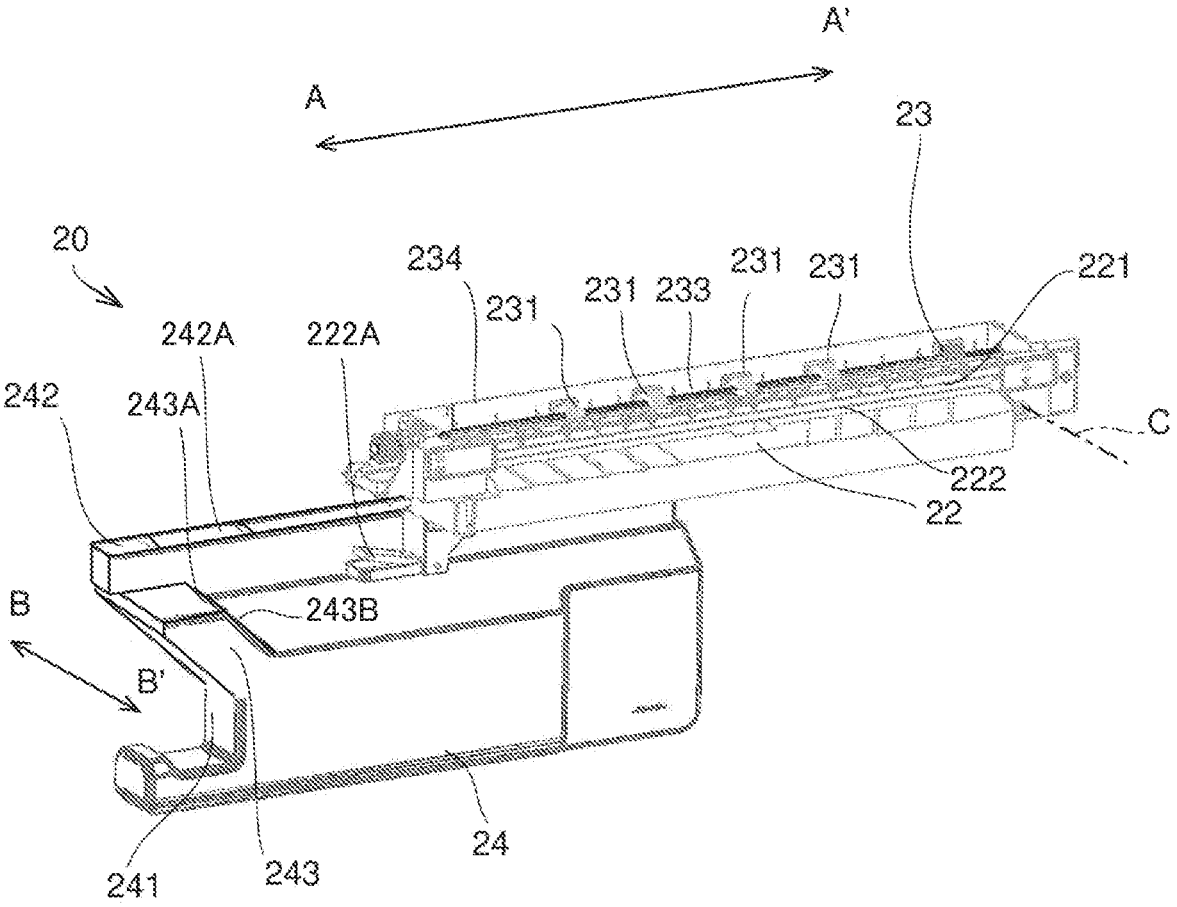
Figure 6:
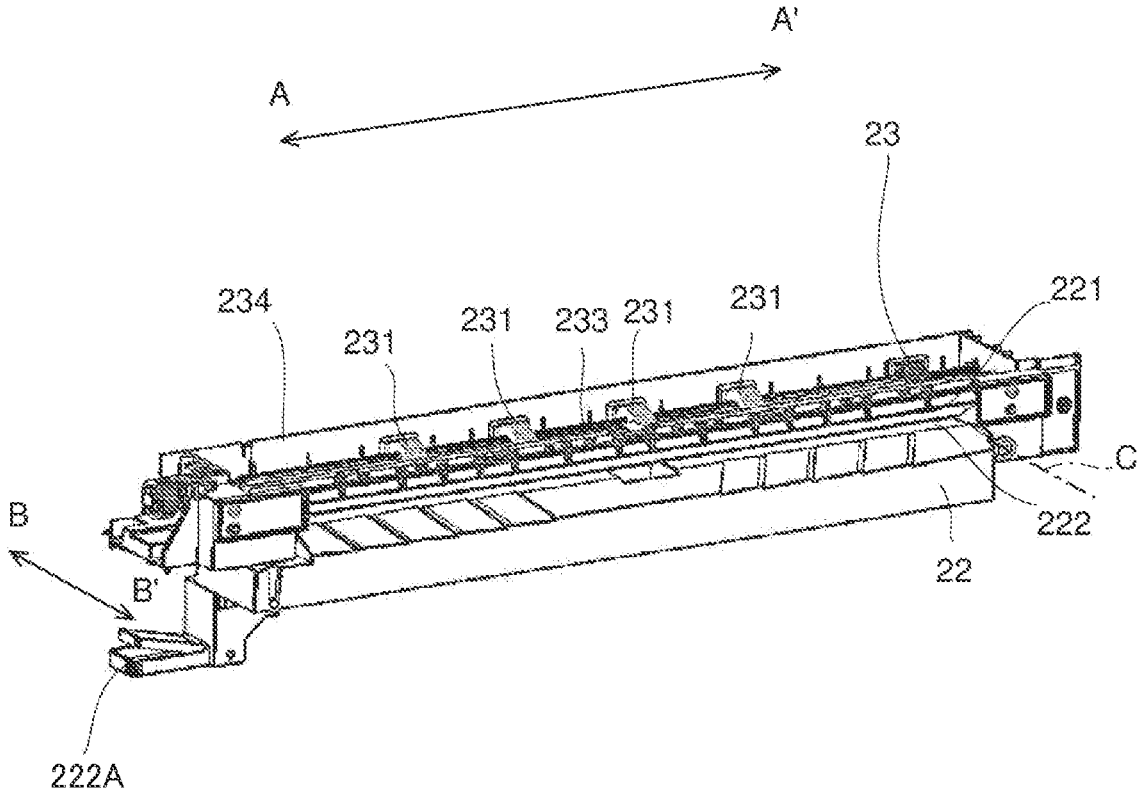
FIG. 6 and FIG. 7 are perspective views for explaining an operation of a lower guide 222 provided in the sheet postprocessing apparatus 1.
Figure 7:
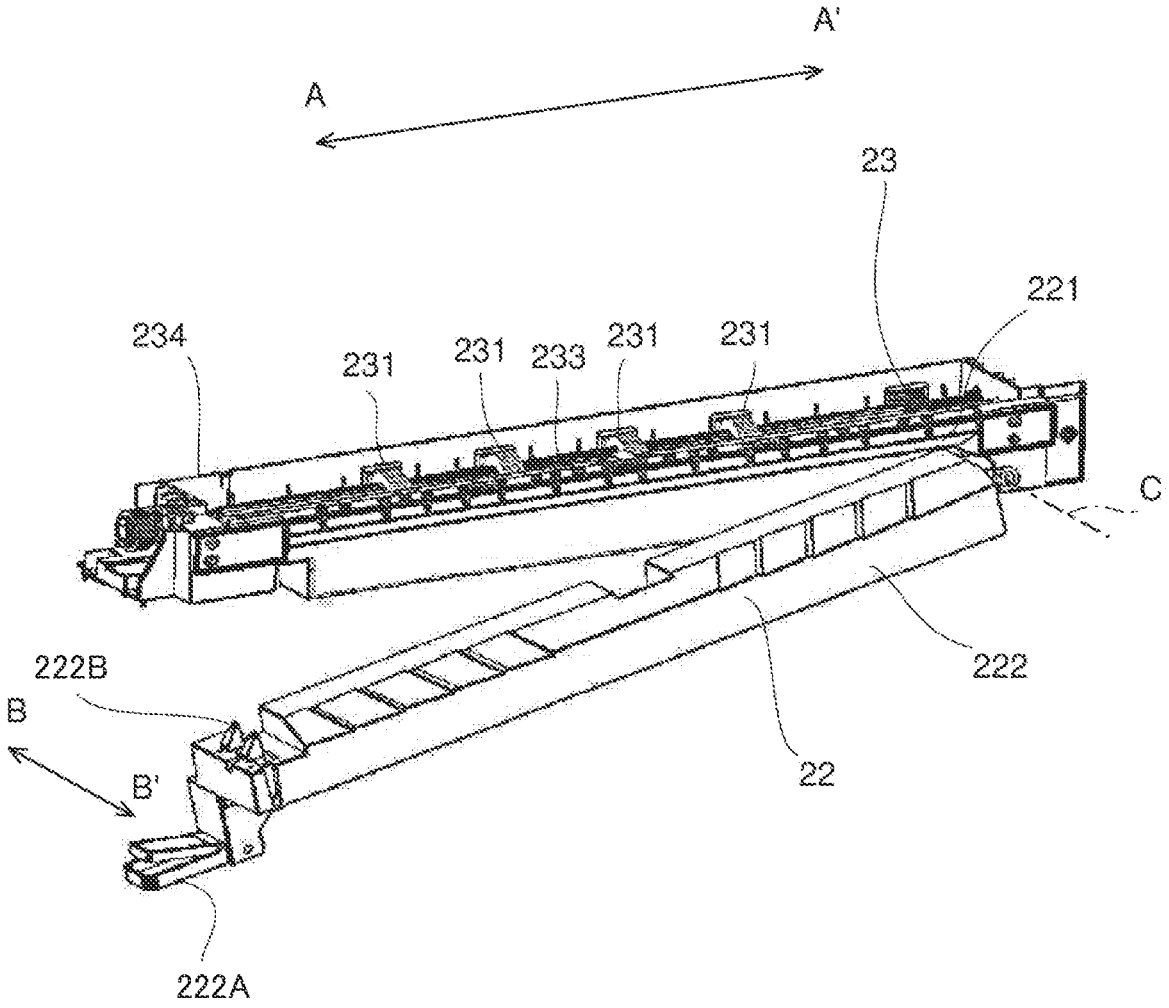

Hereunder, a configuration of the perforation device 20 will be described. FIG. 3 is a side cross-sectional view showing the perforation device 20 provided in the sheet postprocessing apparatus 1. FIG. 4 and FIG. 5 are perspective views each showing the perforation device 20. FIG. 6 and FIG. 7 are perspective views for explaining the operation of a lower guide 222.

The perforation device 20 includes an inlet guide 22, a punching device 23, and a collection tank 24.

The inlet guide 22 includes an upper guide 221 and a lower guide 222. The upper guide 221 and the lower guide 222 are opposed to each other in the up-down direction, with a predetermined clearance therebetween. The upper guide 221 constitutes the upper wall of a portion of the first sheet transport route 3 in the proximity of the sheet inlet (entrance) 2. The lower guide 222 constitutes the lower wall of the portion of the first sheet transport route 3 in the proximity of the sheet inlet 2.

The lower guide 222 is supported so as to pivot in the up-down direction with respect to the upper guide 221, about an end portion on the side of A' in the axial direction A-A', corresponding to the sheet width direction (see FIG. 7).

In this embodiment, the lower guide 222 is configured to pivot about a rotation axis C, located at the end portion on the side of A' in the axial direction A-A', corresponding to the sheet width direction. The rotation axis C extends in the first sheet transport direction (B-B' direction). The lower guide 222 includes a lever 222A. The lever 222A is located on the end portion of the lower guide 222, on the other side A in the axial direction A-A', corresponding to the sheet width direction. The lever 222A is configured to cancel the engagement between the lower guide 222 and the upper guide 221. In this embodiment, an engagement piece 222B (see FIG. 7) located on the upper face of the lower guide 222 is made to move, when the lever 222A is operated. By cancelling the engagement between the engagement piece 222B and the upper guide 221, the lower guide 222 is released from the upper guide 221.

The punching device 23 is located downstream of the inlet guide 22, on the side of B in the first sheet transport direction B-B', and perforates the sheet transported from the inlet guide 22. In this embodiment, the punching device 23 includes an eccentric cam 231, a punching blade 232, the shaft 233, and a housing 234.

The housing 234 is located downstream of the upper guide 221 on the side of B in the first sheet transport direction B-B', and formed integrally with the upper guide 221. Inside the housing 234, the eccentric cam 231, the punching blade 232, and the shaft 233 are accommodated. In addition, the first sheet transport route 3 passes through inside of the housing 234, and is communicating with the portion of the first sheet transport route 3 located inside the inlet guide 22.

A plurality of punching blades 232 are aligned along the axial line of the shaft 233, to perforate the sheet. The punching blades 232 are made to reciprocate in the up-down direction, by the rotation of the eccentric cam 231. In this embodiment, four punching blades 232 are provided, to support the four-hole punch system. Here, the number of punching blades 232 is not limited to four. The wall face of the first sheet transport route 3 includes through holes 3A and 3B, formed at the position corresponding to the punching blades 232. The through hole 3A is penetrating through the upper wall of the first sheet transport route 3, in the up-down direction. The through hole 3B is penetrating through the lower wall of the first sheet transport route 3, in the up-down direction (see FIG. 3).

The shaft 233 extends along the direction in which the punching blades 232 are aligned, so as to stride over the punching blade 232. The shaft 233 is rotatably supported by the housing 234.

The eccentric cam 231 is mounted at each of the four points, along the axial direction of the shaft 233, so as to correspond to the punching blade 232. The shaft 233 is connected to the rotary shaft of a motor via a gear, so that when the motor drives the shaft 233 to rotate, the eccentric cam 231 is made to rotate.

When the punching device 23 performs the perforating operation, a contactless sensor, such as an optical sensor, detects whether the sheet transported by the transport roller pair 3R has reached a predetermined position. When it is decided that the sheet has reached the predetermined position, the rotation of the transport roller pair 3R is stopped, so that the sheet stops at the predetermined position.

At this point, the eccentric cam 231 is set at a predetermined angle (hereinafter, retraction angle) that keeps the punching blade 232 from interrupting the transport of the sheet (hereinafter, retracted position), and the sheet remains immobile on the first sheet transport route 3.

Then the eccentric cam 231 is made to rotate in a predetermined direction, from the retraction angle. Accordingly, the punching blade 232 descends toward the sheet from the retracted position, through the through hole 3A. The punching blade 232 descends as far as the punching position for perforating the sheet (lower than the through hole 3B). When the eccentric cam 231 is made to further rotate, the punching blade 232 ascends from the punching position, and returns to the retracted position.

The collection tank 24 is located so as to stride over the punching device 23 and the through holes 3A and 3B in the first sheet transport direction (B-B' direction), to receive the perforation waste created through the perforating operation. The collection tank 24 includes a collection chamber 241, a connecting portion 242, and a restriction device 243. The collection chamber 241, the connecting portion 242, and the restriction device 243 communicate with each other, inside the collection tank 24. The collection chamber 241 is located on the lower side of the punching device 23, to receive the perforation waste.

The connecting portion 242 protrudes upward from a position on the downstream side of the collection chamber 241 in the first sheet transport direction, to be attached to the punching device 23. The connecting portion 242 includes an opening 242A formed on the upper face (see FIG. 5). The perforation waste is created each time the punching device 23 perforates the sheet, and drops downward through the through hole 3B and the opening 242A. The perforation waste that has dropped through the opening 242A is accommodated inside the collection chamber 241 of the collection tank 24.

The collection tank 24 is removably attached to the lower face of the housing 234 of the punching device 23. As an example of the attachment structure, a guide rail is provided on the lower face of the housing 234, and a slide rail is provided on the upper face of the connecting portion 242 of the collection tank 24.

The guide rail and the slide rail extend parallel to the sheet width direction (axial direction A-A'). The end portion of the slide rail on one side in the sheet width direction (side of A' in the axial direction A-A'), and the end portion of the guide rail on the other side in the sheet width direction (side of A in the axial direction A-A') are engaged with each other, and the collection tank 24 is pushed inwardly in the sheet width direction, to the side of A' in the axial direction A-A'. Accordingly, the slide rail is made to slide along the guide rail, so that the collection tank 24 slides in the sheet width direction (axial direction A-A'), to be attached to the housing 234 (see FIG. 4 and FIG. 5). Thus, the collection tank 24 is removably supported, by sliding in the sheet width direction (axial direction A-A'), with respect to the punching device 23.

Conversely, when the collection tank 24 is drawn out in the sheet width direction, to the side of A in the axial direction A-A', the slide rail slides along the guide rail, so that the collection tank 24 is removed from the punching device 23. The collection tank 24 is removed from the punching device 23 when a certain amount of perforation waste is accumulated in the collection tank 24, and the perforation waste is disposed of.

The restriction device 243 is located adjacent to the collection chamber 241, on the downstream side B in the first sheet transport direction. Accordingly, the restriction device 243 is located so as to oppose the lower face of the lower guide 222, when the collection tank 24 is attached to the punching device 23.

To be more specific, the restriction device 243 includes a restriction surface 243A and a sloped surface 243B. The restriction surface 243A and the sloped surface 243B are formed on the upper face of the restriction device 243, such that the restriction surface 243A is opposed to the lower face of the lever 222A, in the up-down direction. The sloped surface 243B is located adjacent to the restriction surface 243A in the sheet width direction, on the side of A' in the axial direction A-A'. The sloped surface 243B is inclined downward, in the direction toward the side of A' in the axial direction A-A'.

Because of the presence of the sloped surface 243B, the lower face of the lever 222A slides along the sloped surface 243B, when the collection tank 24 is pushed in the sheet width direction toward the side A' in the axial direction A-A'. As result, the collection tank 24 can be smoothly attached to the punching device 23.

When the collection tank 24 is attached to the punching device 23, the lower face of the lever 222A makes contact with the restriction surface 243A. Accordingly, even when the user operates the lever 222A by mistake, to cancel the engagement between the upper guide 221 and the lower guide 222, the pivotal movement of the lower guide 222 is restricted by the restriction surface 243A.

Now, the aforementioned existing sheet postprocessing apparatuses have a drawback in that, when paper jam occurs on the transport route, the paper jam is unable to be efficiently fixed. In addition, in the case where a part of the transport route is made openable, the user may open up the part of the transport route by mistake, despite the paper jam not having occurred. In such a case, a malfunction in sheet transport may be incurred.

According to this embodiment, in contrast, the collection tank 24 includes the restriction device 243 which, when the collection tank 24 is attached to the punching device 23, is opposed to the lever 222A to restrict the pivotal movement of the lower guide 222. Further, the restriction device 243 is located at the end portion of the collection tank 24 in the sheet width direction, on the other side A in the axial direction A-A', such that the restriction surface 243A, opposed to the lower face of the lever 222A in the up-down direction, constitutes at least a part of the restriction device 243.

Therefore, the sheet can be prevented from being transported, with a portion of the first sheet transport route 3 in the proximity of the sheet inlet 2 (entrance) opened up. As result, the occurrence of the malfunction in sheet transport can be prevented.

In the case where the paper jam occurs on the first sheet transport route 3, the collection tank 24 is removed from the punching device 23, and then the lever 222A is operated. Such an operation enables the lower guide 222 to pivot downward, to open up the sheet inlet 2 (entrance) of the first sheet transport route 3, and to fix the paper jam.

Second Embodiment

Figure 8:
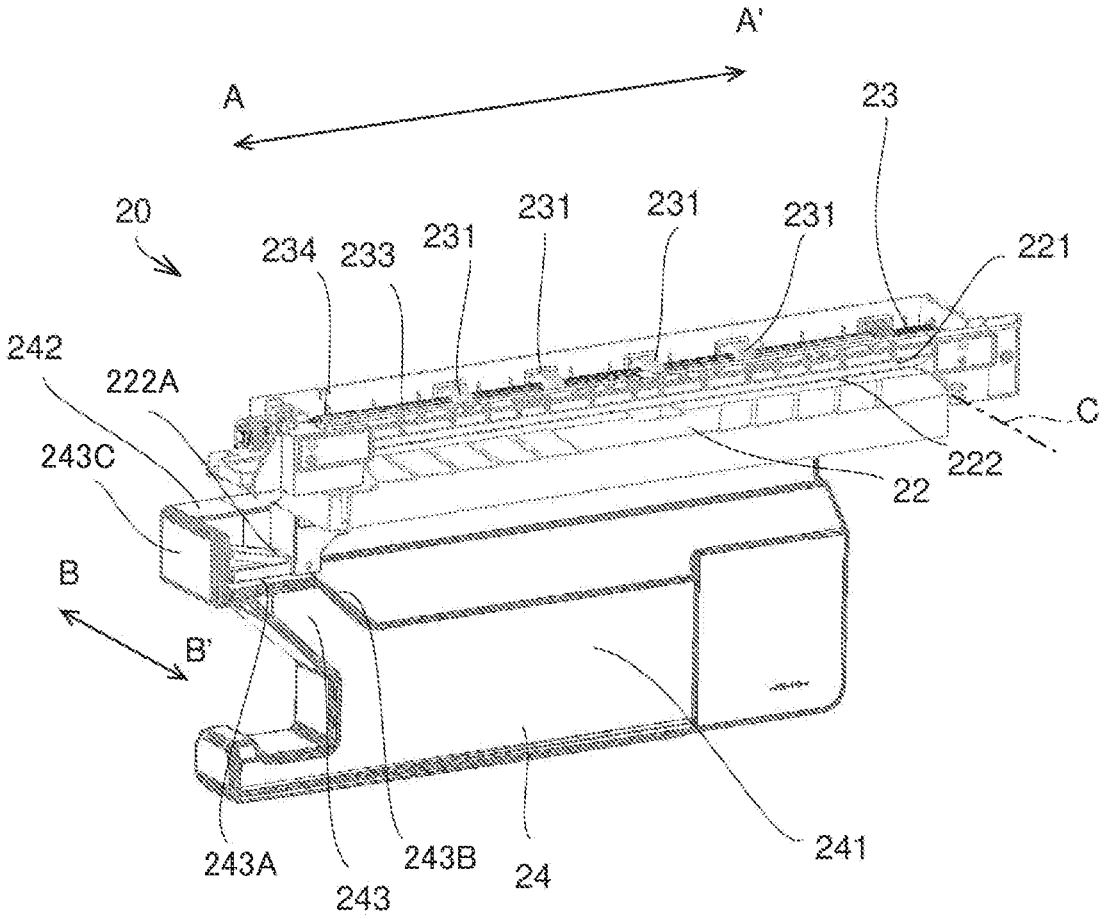
FIG. 8 is a perspective view showing the perforation device 20 provided in the sheet postprocessing apparatus 1 according to a second embodiment of the disclosure.

Hereunder, a second embodiment of the disclosure will be described. FIG. 8 is a perspective view showing the perforation device 20 provided in the sheet postprocessing apparatus 1 according to the second embodiment of the disclosure. For the sake of convenience in description, the same elements as those of the first embodiment shown in FIG. 1 to FIG. 7 are given the same numeral. In the second embodiment, the restriction device 243 further includes a cover 243C. The configuration of the remaining portions is the same as in the first embodiment.

The cover 243C is erected from the end portion of the restriction surface 243A in the sheet width direction, on the other side A of the axial direction A-A'. The cover 243C constitutes a part of the restriction device 243, and is opposed to the lever 222A in the sheet width direction (axial direction A-A').

The cover 243C covers the lever 222A from the other side A in the axial direction A-A', when collection tank 24 is attached to the punching device 23. Accordingly, the cover 243C keeps the lever 222A from being operated. Such a configuration further assures that the user is prevented from operating the lever 222A by mistake, which further reduces the likelihood that the malfunction in sheet transport is incurred.

Further, the upper end of the cover 243C is at a higher position than the upper end of the lever 222A. Accordingly, it is difficult for the user to visually recognize the lever 222A, when the collection tank 24 is attached to the punching device 23. Such a configuration further assures that the user is prevented from operating the lever 222A by mistake.

Although the embodiments of the disclosure have been described as above, the scope of the disclosure is not limited to the foregoing embodiments, but may be modified in various manners without departing from the spirit of the disclosure. For example, although the lower face of the lever 222A is in contact with the restriction surface 243A, when the collection tank 24 is attached to the punching device 23, in the foregoing embodiments, the lower face of the lever 222A may be opposed to the restriction surface 243A in the up-down direction, via a clearance therebetween. In this case, the pivotal movement of the lower guide 222 is restricted by the restriction surface 243A.

INDUSTRIAL APPLICABILITY

The disclosure is applicable to sheet postprocessing apparatuses configured to perform predetermined postprocessing on a plurality of sheets.

While the present disclosure has been described in detail with reference to the embodiments thereof, it would be apparent to those skilled in the art the various changes and modifications may be made therein within the scope defined by the appended claims.

What is claimed is:

1. A sheet postprocessing apparatus comprising:

an inlet guide including an upper guide constituting an upper wall of a transport route through which a sheet is transported, and a lower guide constituting a lower wall of the transport route;

a perforation device located downstream of the inlet guide in a sheet transport direction, and configured to perforate the sheet delivered from the inlet guide; and a collection tank located on a lower side of the perforation device, and configured to receive perforation waste, created through a perforating operation, wherein the lower guide is supported so as to pivot in an up-down direction with respect to the upper guide, about an end portion in a sheet width direction, orthogonal to the sheet transport direction, the collection tank is removably supported, by sliding in the sheet width direction, with respect to the perforation device, the lower guide includes a lever located on the other end portion in the sheet width direction, and configured to cancel engagement between the lower guide from the upper guide, and the collection tank includes a restriction device opposed to the lever and configured to restrict a pivotal movement of the lower guide, when the collection tank is attached to the perforation device.

2. The sheet postprocessing apparatus according to claim 1, wherein the restriction device is located on an end portion of the collection tank on the other side in the sheet width direction, and includes, as at least a part thereof, a restriction surface opposed to a lower face of the lever in the up-down direction, when the collection tank is attached to the perforation device.

3. The sheet postprocessing apparatus according to claim 2, wherein the restriction device includes, as at least a part thereof, a cover erected from and end portion of the restriction surface on the other side in the sheet width direction, and opposed to the lever in the sheet width direction.

4. The sheet postprocessing apparatus according to claim 2, wherein the restriction device further includes a sloped surface located adjacent to one side of the sheet width direction, and the sloped surface is inclined downward toward the one side in the sheet width direction.

5. The sheet postprocessing apparatus according to claim 1, wherein the perforation device includes:

a shaft;

an eccentric cam attached to the shaft; and a plurality of punching blades aligned along an axial line of the shaft, to be made to reciprocate by rotation of the eccentric cam, thereby perforating the sheet, the lower guide is supported so as to pivot in the up-down direction, about an end portion of the shaft on one side in an axial direction, the lever is located at an end portion of the lower guide on the other side in the axial direction, and the restriction device includes, as at least a part thereof, a restriction surface located on an end portion of the collection tank on the other side in the axial direction, and brought into contact with a lower face of the lever in the up-down direction, when the collection tank is attached to the perforation device.

6. An image forming system comprising:

the sheet postprocessing apparatus according to claim 1; and an image forming apparatus that forms an image on the sheet, and delivers the sheet to the transport route.

* * * * *